US007658025B2

(12) United States Patent
Bentley

(10) Patent No.: US 7,658,025 B2
(45) Date of Patent: Feb. 9, 2010

(54) RETAINER PIN AND TOOTH FOR TOOTH AND ADAPTOR ASSEMBLY

(75) Inventor: Neil Douglas Bentley, Edmonton (CA)

(73) Assignee: AMSCO Cast Products (Canada) Inc., Edmonton, Alberta (CA)

( * ) Notice: Subject to any disclaimer, the term of this patent is extended or adjusted under 35 U.S.C. 154(b) by 0 days.

(21) Appl. No.: 12/170,764

(22) Filed: Jul. 10, 2008

(65) Prior Publication Data

US 2009/0044435 A1 Feb. 19, 2009

(30) Foreign Application Priority Data

Aug. 14, 2007 (CA) ..... 2597277

(51) Int. Cl.
*E02F 9/28* (2006.01)

(52) U.S. Cl. ..... 37/456; 37/452

(58) Field of Classification Search ..... 37/452–459; 403/379, 374, 322.2, 328; 172/701.1, 701.3, 172/719, 772, 772.5, 749–753
See application file for complete search history.

(56) References Cited

U.S. PATENT DOCUMENTS

| | | | | |
|---|---|---|---|---|
| 3,526,435 | A * | 9/1970 | Krekeler | 299/109 |
| 3,685,178 | A | 8/1972 | Ratkowski | |
| 3,774,324 | A | 11/1973 | Lafond | |
| 4,369,854 | A | 1/1983 | Butterworth | |
| 4,404,760 | A | 9/1983 | Hahn et al. | |
| 4,481,728 | A | 11/1984 | Mulder et al. | |
| 4,848,013 | A * | 7/1989 | Bowman et al. | 37/457 |
| 5,177,886 | A | 1/1993 | Klett | |
| 5,469,648 | A | 11/1995 | Jones et al. | |
| 5,491,915 | A | 2/1996 | Robinson | |
| 5,561,925 | A | 10/1996 | Livesay | |
| 5,833,323 | A * | 11/1998 | Massa et al. | 299/102 |
| 5,983,534 | A | 11/1999 | Robinson et al. | |
| 5,992,063 | A * | 11/1999 | Mack | 37/450 |
| 6,018,896 | A | 2/2000 | Adamic | |
| 6,151,812 | A | 11/2000 | Bierwith | |
| 6,491,469 | B1 | 12/2002 | Pasqualini et al. | |
| 6,502,336 | B2 * | 1/2003 | Pippins | 37/458 |
| 6,668,472 | B2 | 12/2003 | Bierwith | |
| 6,725,582 | B2 | 4/2004 | Adamic et al. | |
| 6,735,890 | B2 | 5/2004 | Carpenter et al. | |
| 6,871,426 | B2 | 3/2005 | Keech et al. | |

(Continued)

FOREIGN PATENT DOCUMENTS

| | | |
|---|---|---|
| CA | 1243059 | 10/1988 |

*Primary Examiner*—Robert E Pezzuto
(74) *Attorney, Agent, or Firm*—Dinsmore & Shohl LLP

(57) ABSTRACT

A retainer pin assembly and tooth for an excavation tooth and adaptor assembly is provided. The retainer pin assembly can comprise at least one retainer pin section having a circular longitudinal main body with chamfered leading edges at one end for insertion into a passageway in the adaptor, and a displacement-bearing block having at least one facet disposed at the opposite end. The tooth can comprise at least one opening on a sidewall having one flat vertical bearing surface to correspond to a facet of the displacement-bearing block when a retainer pin section is inserted into the adaptor passageway. Magnets can be disposed on the chamfered ends of a pair of retainer pin sections to urge the retainer pin sections towards one another when inserted in the adaptor passageway.

17 Claims, 11 Drawing Sheets

U.S. PATENT DOCUMENTS

| | | | |
|---|---|---|---|
| 7,052,223 | B1 | 5/2006 | Miller |
| 2005/0011089 | A1 | 1/2005 | Duke |
| 2005/0144817 | A1 | 7/2005 | Pasqualini et al. |
| 2005/0241195 | A1 | 11/2005 | Bierwith |

* cited by examiner

RETAINER PIN AND TOOTH FOR TOOTH AND ADAPTOR ASSEMBLY

CROSS REFERENCES TO RELATED APPLICATIONS

This application claims the benefit of and priority to Canadian Application No. 2,597,277 filed on Aug. 15, 2007, which is hereby incorporated by reference.

TECHNICAL FIELD

The present invention relates to the field of retainer pins and teeth, more particularly, retainer pins and teeth for use with teeth and adaptor assemblies mounted on excavation tools such as buckets as used on front-end loaders, backhoes and the like.

BACKGROUND

The practice of excavation for construction and mining applications can be more effectively managed when teeth and adaptor assemblies are attached to the leading edge or lip of an excavator bucket. The chisel-like profile of the teeth provide an efficient means of penetrating hardened earthen materials since the tip of the teeth has far less mass than the broad leading edge of the bucket lip. The full force of the excavation equipment can be then applied to the tip of the teeth. Any number of teeth can be changed out on the adaptor as each becomes worn out and replaced.

An example of a commonly used tooth and adaptor system is illustrated in FIG. 1. Prior art tooth and adaptor assembly A is presently produced by numerous manufacturers worldwide. This basic system has been widely used for several decades since it has a simple design and is easily manufactured at a low cost. Typically, a plurality of teeth and adaptor assemblies A are rigidly mounted at equal spaces to excavation bucket lip B. This system is dependable and offers exceptional structural strength since retainer pinhole E is located on the vertical side of tooth C and retainer pin F is installed and removed horizontally from the side of assembly A as depicted in FIG. 1. Hammer H is used to hammer retainer pin F into and through spring clamp I, which maintains the position of retainer pin F in assembly A.

Assembly A is typically assembled as follows: Retainer pin spring clamp I is initially installed into recess hole J in the side of adaptor D and held in position until tooth C is fully seated onto adaptor D. Retainer pin F is then introduced into pinhole E on either vertical sidewall of tooth C and hammered horizontally and fully into position in pinhole K in adaptor D. FIG. 2 illustrates a cross-sectional view of tooth C fully seated onto adaptor D with spring clamp I seated in pin groove L thereby maintaining retainer pin F in the "home" position.

The shortcomings of this popular tooth and adaptor system lie in the installation and removal of retainer pin F during routine maintenance. The close proximity of these mounted assemblies A on an excavation bucket do not permit clear, direct access to tooth retainer pinhole E. Therefore, it can be an arduous exercise to replace tooth C on adaptor D. The installation of tooth C necessitates significant hammering with an adequate hammer H to push retainer pin F through spring clamp I to the fully seated position in adaptor D. It can then take numerous impact blows to drift punch tool G (which can be misaligned due to the close proximity of assemblies A) to initiate movement of retainer pin F out through pinhole E and subsequent impact blows to fully remove retainer pin F. The whole of this maintenance service work is impeded by not having clear, direct access to retainer pinhole E in tooth C. These maintenance procedures have been the accepted norm for many years.

It is, therefore, desirable to provide a retainer pin and tooth for a tooth and adaptor assembly that are simple, easy and safe to install and remove.

SUMMARY

A retainer pin and tooth is provided for teeth and adaptor assemblies used on excavation tools. In one embodiment, the retainer pin can comprise at least one retainer pin section having a longitudinal axis. The section can be circular in cross section although any other suitable cross sectional shape can be used as obvious to those skilled in the art. The diameter or cross sectional area of the retainer pin section can be selected to allow the retainer pin section to have a close or tight sliding fit with a retainer pin passageway disposed through an adaptor yet still allow easy insertion and removal from the passageway.

In another embodiment, a bearing block is disposed at the outer end of the retainer pin section that is larger in diameter or cross sectional area than the retainer pin section itself. In one embodiment, the bearing block can have at least one flat side or facet substantially parallel to the longitudinal axis. In other embodiments, the bearing block can have multiple flat sides or facets disposed about the circumference of the bearing block, all substantially parallel to the longitudinal axis. In other embodiments, magnets can be disposed on the inner ends of a pair of complementary pin sections, the magnets being configured to attract one another when in close proximity to one another. When the complementary pin sections are inserted, inner end first, through the opposing openings on a tooth into an adaptor passageway, the magnets can attract one another to substantially keep the pin sections in the adaptor passageway thereby securing the tooth to the adaptor.

In one embodiment, the tooth can have at least one retainer pin opening on a sidewall of the tooth that substantially aligns with a corresponding retainer pin passageway disposed on an adaptor when the tooth is substantially seated on the adaptor. In other embodiments, the tooth can have retainer pin openings on opposing sidewalls of the tooth. The tooth retainer pin openings can have a planar flat surface disposed on the sidewall of the opening, the planar flat surface substantially parallel to the longitudinal axis of the adaptor passageway. The tooth planar flat surface aligns with a facet on the bearing block when a retainer pin section is inserted through the tooth openings into the adaptor passageway such that the facet will contact or seat against the planar flat surface. In a representative embodiment, the tooth openings can be D-shaped although triangular, rectangular or any other polygonal shape can be used as obvious to those skilled in the art to provide a contact surface for a bearing block facet. By virtue of the bearing block being larger in diameter than the retainer pin sections, the bearing block can contact the adaptor when the retainer pin section is fully inserted into the adaptor passageway to prevent the pin section from being inserted too far into the passageway. In further embodiments, the bearing block can further comprise means for indexing the retainer pin with respect to the planar flat surface of the retainer pin opening as explained as follows. Each facet on the bearing block can be positioned from the longitudinal axis of the pin section by a different distance than any other facet. In so providing, multiple "index" positions can be provided on the retainer pin sections. As variations can occur in the dimensions of the tooth retainer pin opening during manufacture of the tooth and/or adaptor, and as wear can occur on the adaptors, the degree to which the tooth retainer pin openings align with the adaptor passageway can vary. To securely seat the tooth onto the adaptor, the bearing block can be rotated or "indexed" to the particular facet that provides a snug sliding fit with the planar flat surface in the tooth opening when the retainer pin section is fully inserted into the adaptor to securely seat the tooth to the adaptor.

When retainer pin sections are fully inserted into the adaptor on both sides of the tooth, the magnets on the inner ends of the pin sections can attract one another and prevent the pin sections from falling out of the adaptor passageway. In further embodiments, the outer ends of the pin sections can further comprise lugs that enable the grasping and/or prying the retainer pin sections from the adaptor passageway using a pry bar or any other suitable tool to enable the removal of the tooth when the tooth is to be replaced.

DETAILED DESCRIPTION OF EMBODIMENTS

Figure 1:
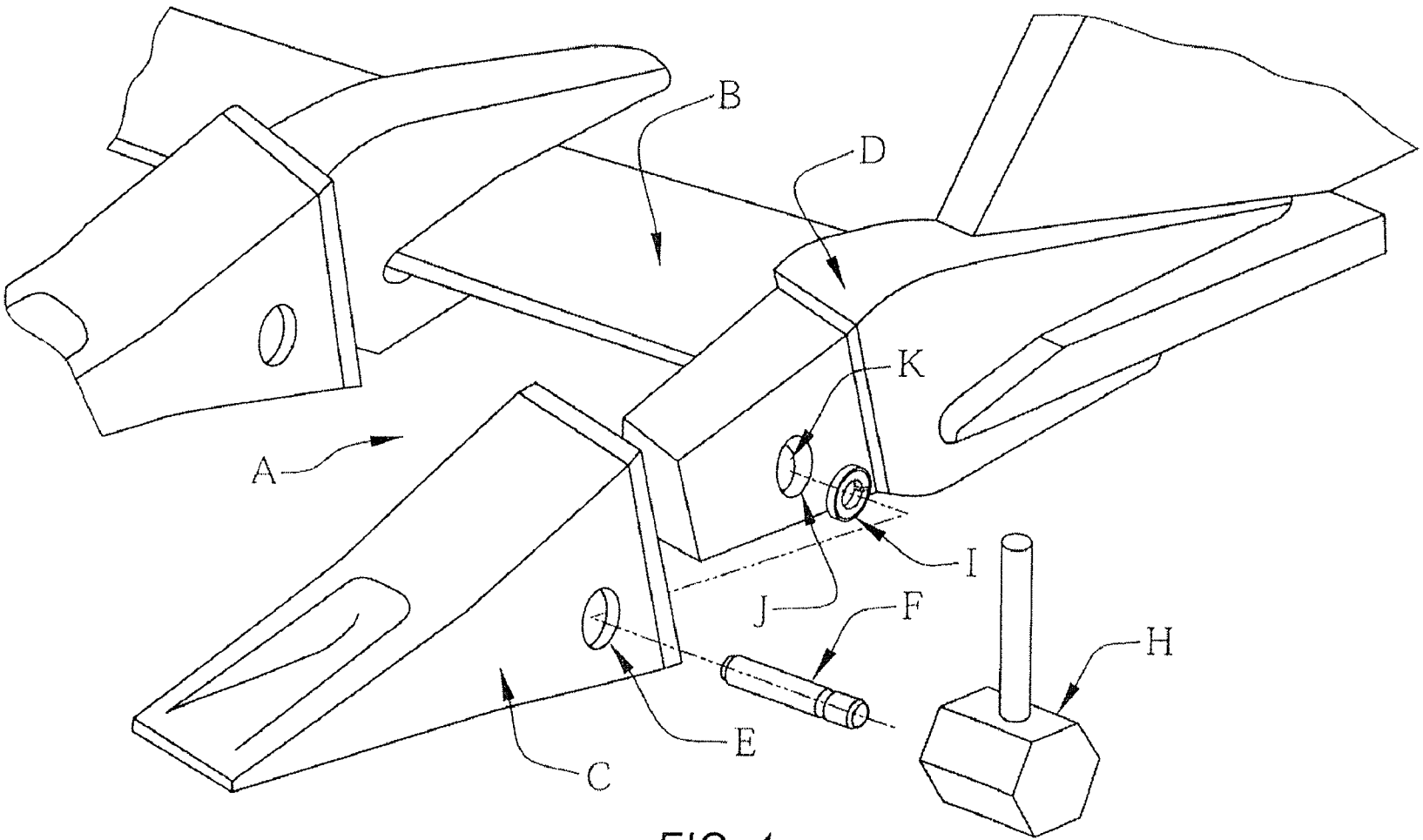
FIG. 1 (PRIOR ART)
FIG. 1 is a perspective exploded view depicting a tooth and adaptor assembly being assembled with a prior art retainer pin system.
Figure 2:
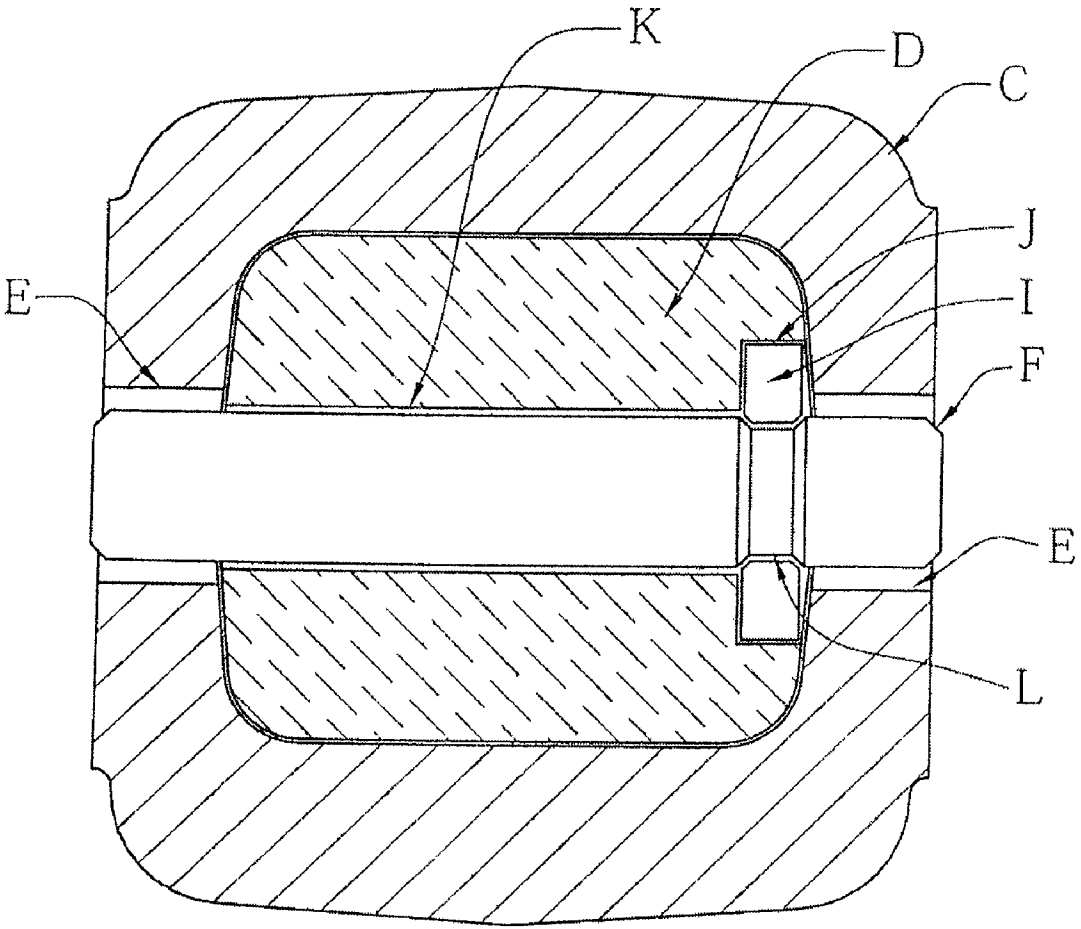
FIG. 2 (PRIOR ART)
FIG. 2 is a cross-section view depicting an assembled tooth and adaptor assembly secured with the prior art retainer pin system of FIG. 1.
Figure 3:
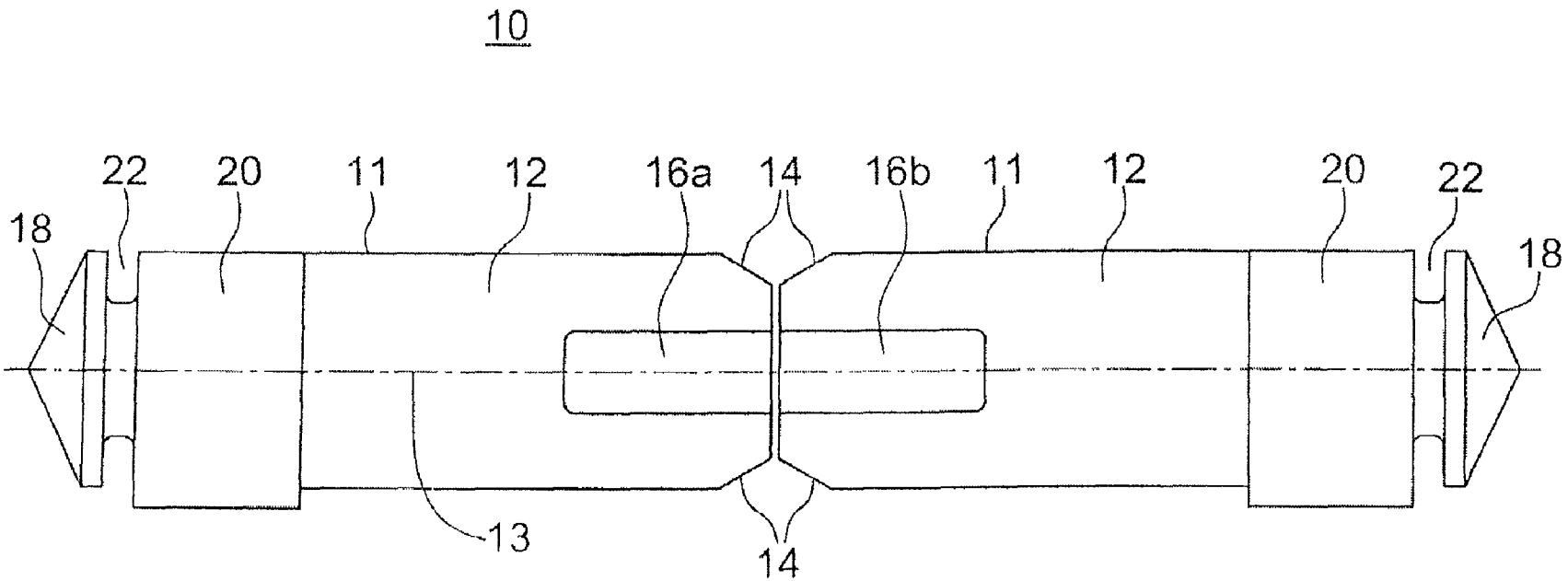
FIG. 3 is a side elevation view depicting one embodiment of a retainer pin assembly.

Referring to FIG. 3, an embodiment of retainer pin 10 is illustrated. Retainer pin 10 can comprise one or more retainer pin sections 11 each having longitudinal axis 13. Each pin section 11 can comprise pin body 12 and bearing block 20. Disposed on the inner ends of pin bodies 12 are magnets 16*a* and 16*b*. Pin bodies 12 can further comprise chamfered leading edges 14 for allowing easy insertion into an adaptor passageway. The cross-sectional area of pin body 12 can be circular in one embodiment but can also be triangular, rectangular, elliptical, polygonal or any other suitable cross-sectional area. Magnets 16*a* and 16*b* are configured such that they attract one another when in close proximity to one another. Disposed on the outer ends of pin sections 11 are bearing blocks 20. Bearing blocks 20 can have a cross-sectional area and/or diameter that is larger than that of pin bodies 12. In further embodiments, lugs 18 can be disposed on the outer ends of pin sections 11. Lugs 18 can further comprise relief area 22 disposed between lug 18 and bearing block 20 for allowing a pry bar or any other suitable tool for removing pin section 11 from a tooth and adaptor assembly.

Figure 4:
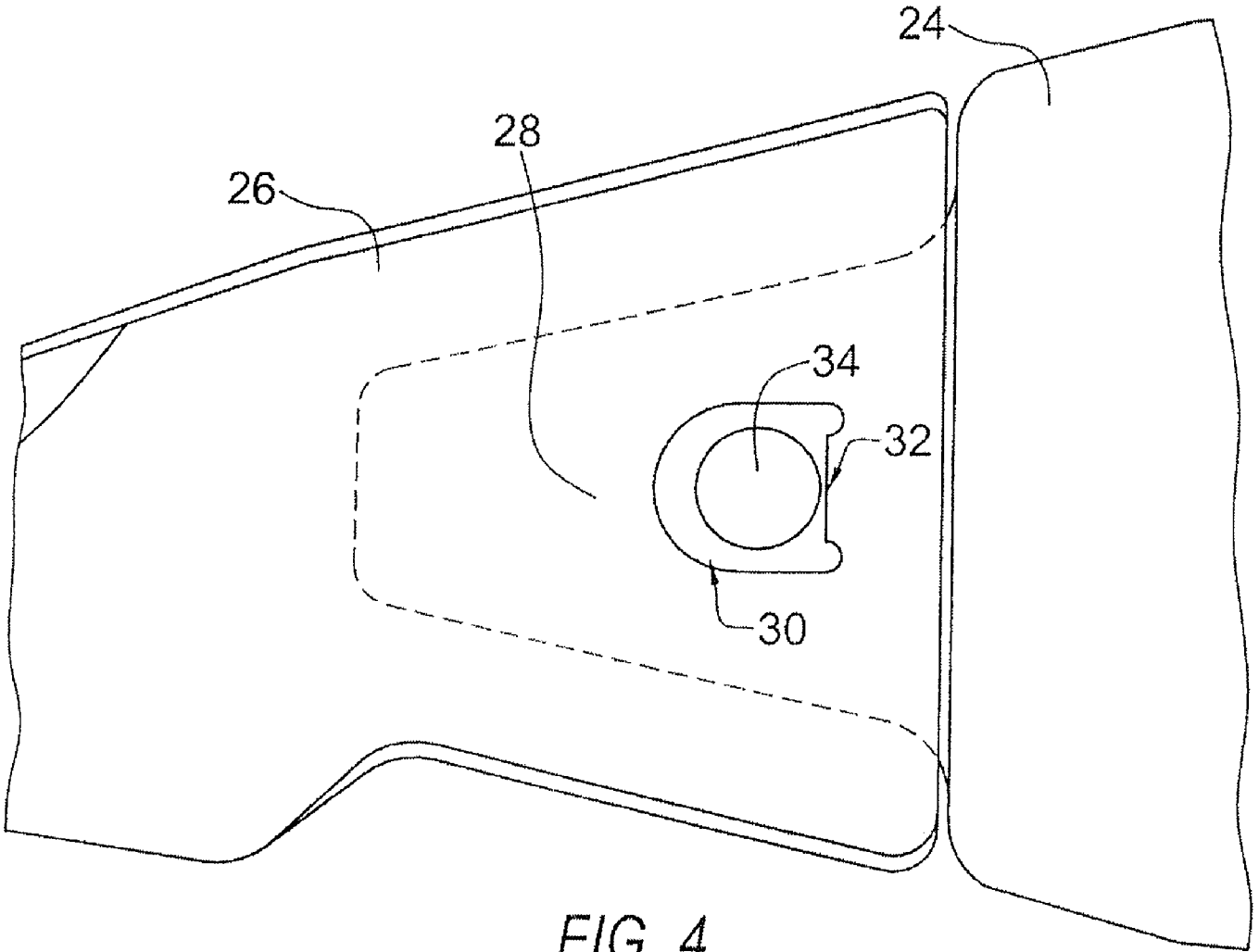
FIG. 4 is a side elevation view depicting a tooth seated on an adaptor with the tooth having an opening for receiving the retainer pin assembly of FIG. 3.

Referring to FIG. 4, tooth 26 is shown seated on adaptor 24. Opening 30 can be disposed on to sidewall 28. Opening 30 can extend all the way through to sidewall 28 to reveal passageway 34 extending through adaptor 24 when tooth 26 is seated on adaptor 24. In the illustrated embodiment, opening 30 is shown as being D-shaped having one flat bearing surface 32. It is obvious to those skilled in the art that opening 30 can have any suitable shape that can provide flat bearing surface 32 therein.

Figure 5:
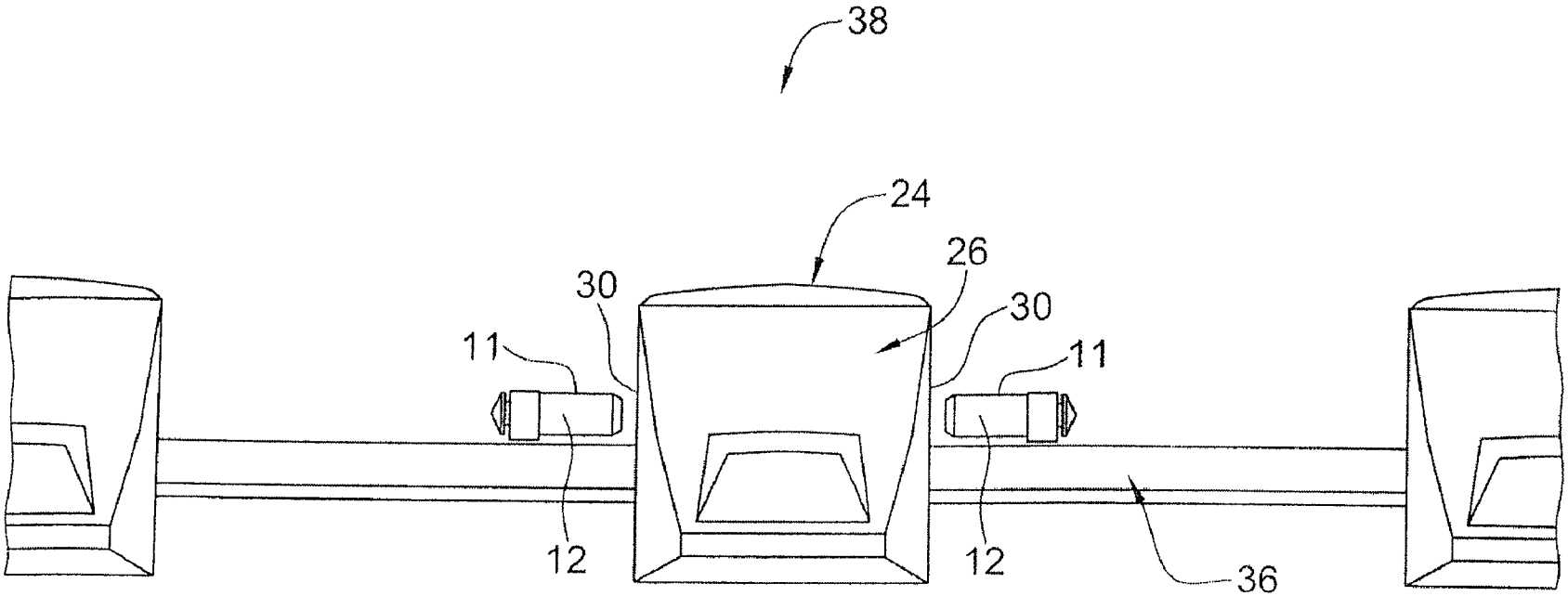
FIG. 5 is a front elevation view depicting a tooth being secured to an adaptor using the retainer pin assembly of FIG. 3.

Referring to FIG. 5, adaptor 24 is shown attached to bucket lip 36 of bucket 38 with tooth 26 seated on adaptor 24. As shown, pin sections 11 are about to be inserted through openings 30 on tooth 26 into passageway 34 (not shown) of adaptor 24. The diameter of pin bodies 12 can be selected to provide a close and tight sliding fit with passageway 34 of adaptor 24 while still providing easy insertion and removal of pin section 11 from passageway 34.

Figure 6:
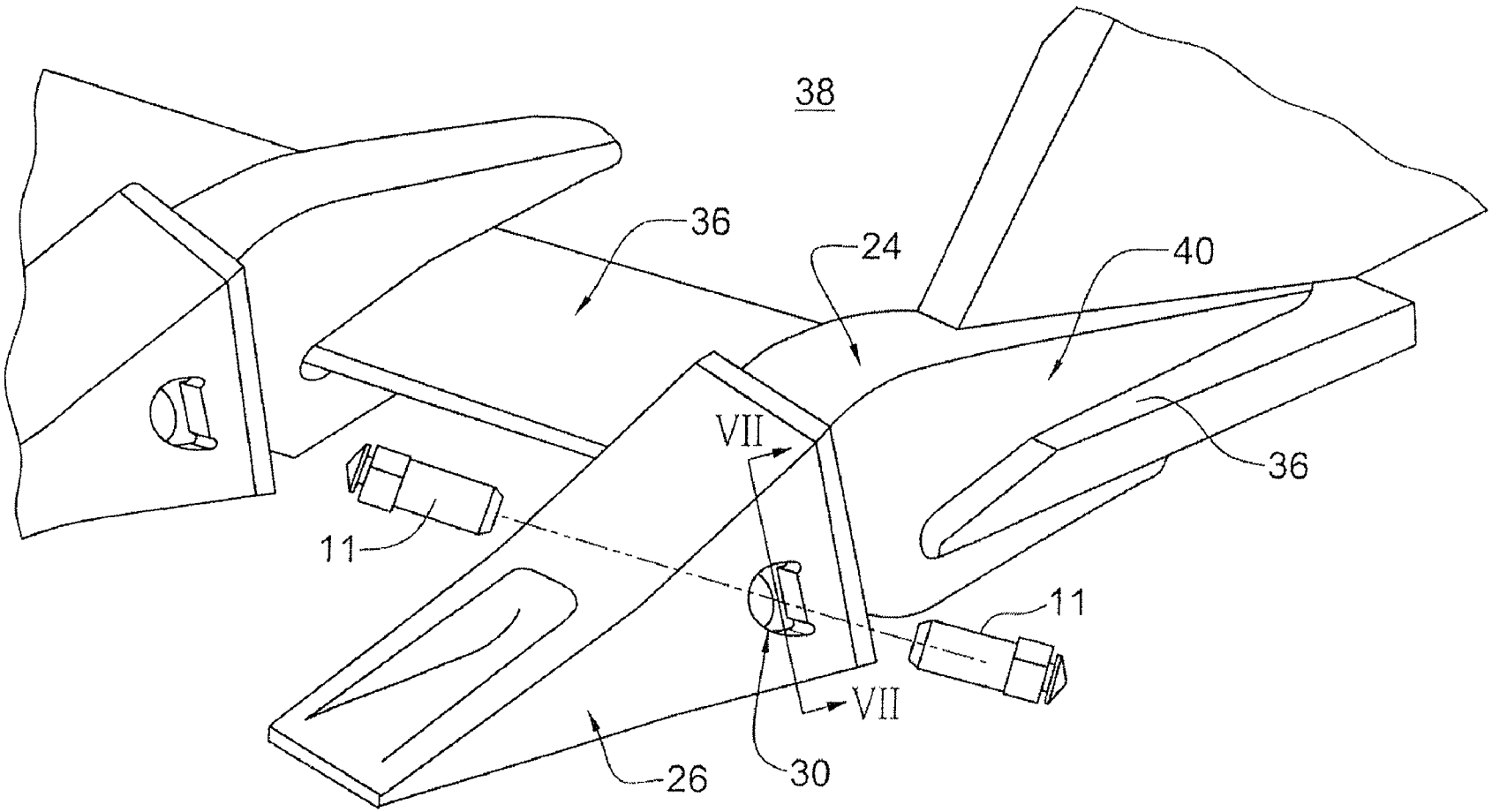
FIG. 6 is a perspective view depicting a tooth being secured to an adaptor using the retainer pin assembly of FIG. 3.
Figure 7:
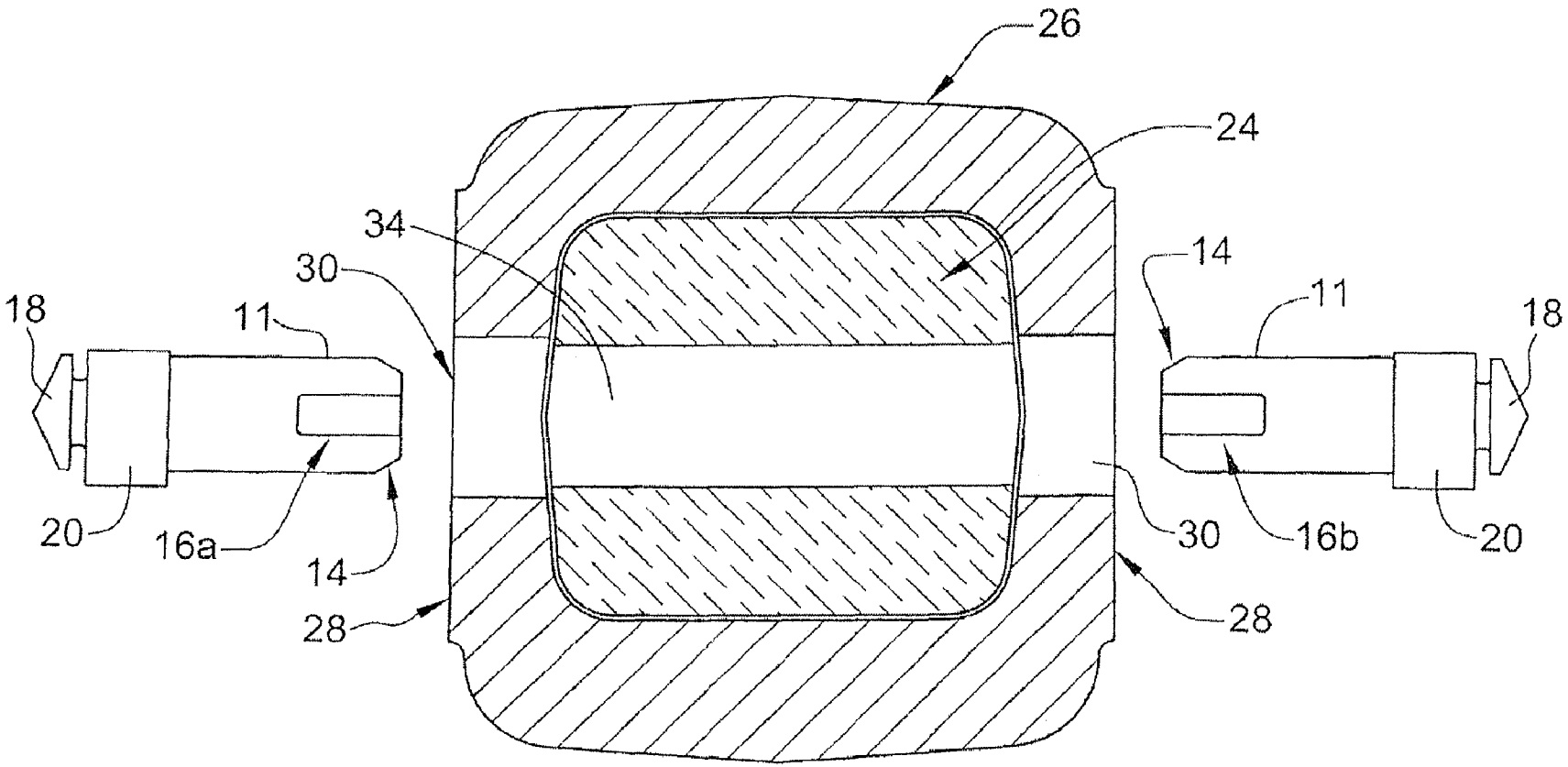
FIG. 7 is an exploded cross section view depicting the tooth and adaptor of FIG. 6 along section line VII-VII.

Referring to FIGS. 6 and 7, pin sections 11 are about to be inserted through openings 30 on tooth 26 into passageway 34 of adaptor 24. U-shaped member 40 of adaptor 24 is attached to bucket lip 36 of bucket 38.

Figure 8:
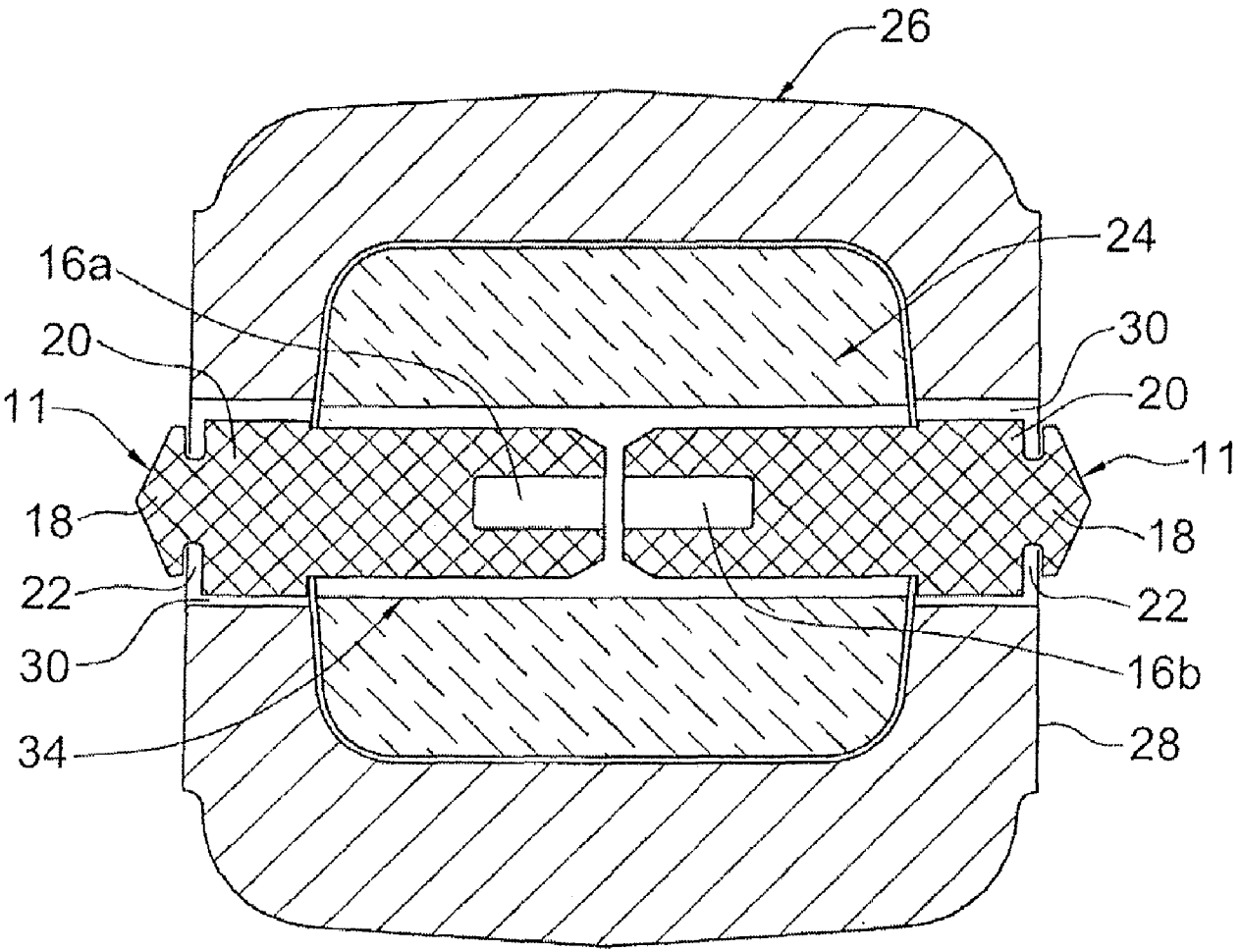
FIG. 8 is a cross section view depicting the tooth and adaptor of FIG. 6 along section line VII-VII with the retainer pins fully inserted.

Referring to FIG. 8, pin sections 11 are shown inserted in passageway 34 of adaptor 24. Bearing blocks 20 contact the side of adaptor 24 by virtue of bearing blocks 20 being larger in diameter than the diameter passageway 34. Magnets 16*a* and 16*b* can be configured to attract one another so as to substantially keep pin sections 11 in passageway 34. In so doing, tooth 26 can be retained on adaptor 24. To remove pin sections 11 from passageway 34, a prying tool such as a screwdriver, a pry bar or any other suitable tool can be inserted in relief area 22 beneath lugs 18 to pull pin section 11 away from the adjacent pin section 11.

Figure 9A:
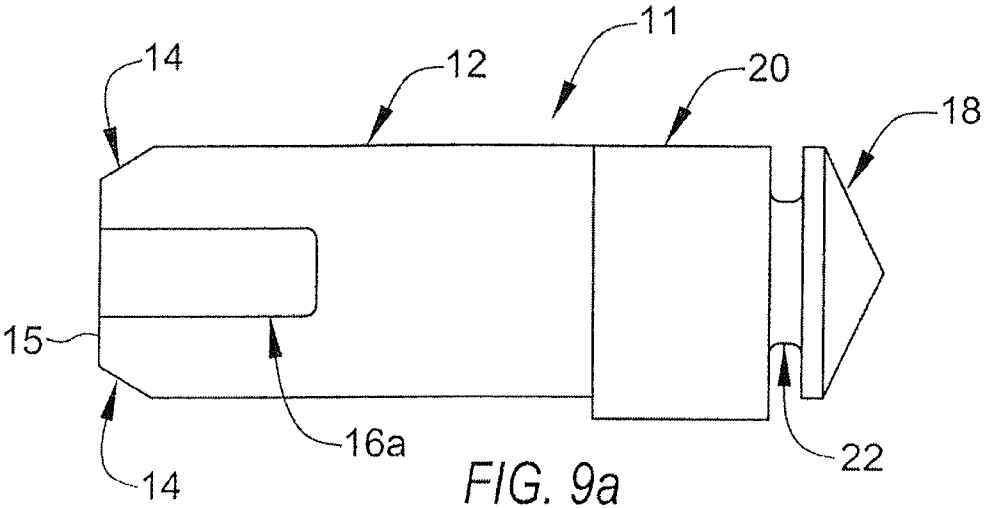
FIG. 9*a* is a side elevation view depicting one half of the retainer pin assembly of FIG. 3.
Figure 9B:
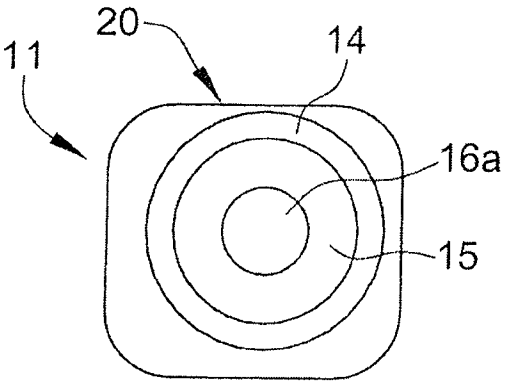
FIG. 9*b* is an end elevation view depicting one half of the retainer pin assembly of FIG. 3.

Referring to FIGS. 9*a* and 9*b*, detailed illustrations of one embodiment of retaining pin section 11 are shown. In these illustrations, pin body 12 can have a circular cross-section and chamfered edges 14 on inner end 15 of pin section 11. Magnet 16*a* is disposed on inner end 15 of pin section 11. Bearing block 20 is illustrated as being substantially rectangular and larger in cross-sectional area than pin body 12.

Figure 10B:
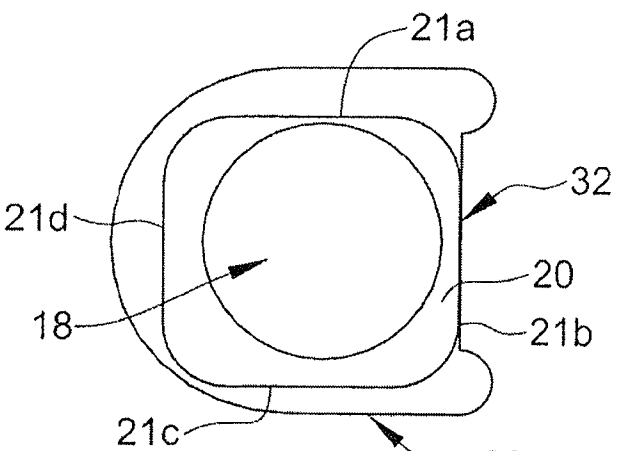
FIG. 10*b* is a side elevation view depicting a retainer pin inserted in the retainer pin opening of FIG. 10*a*.
Figure 10A:
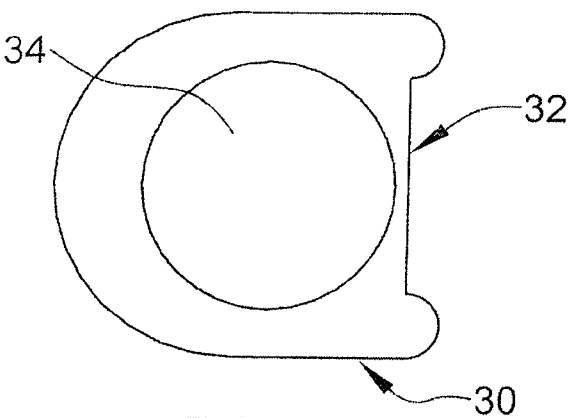
FIG. 10*a* is a side elevation view depicting the retainer pin opening of the tooth of FIG. 4.

Referring to FIG. 10*a*, a close-up view of tooth opening 30 is shown when the tooth is seated on the adaptor thereby exposing the passageway 34. In this embodiment, opening 30 has planar flat surface 32 disposed on the sidewall for aligning with bearing block 20 on retainer pin section 11. Referring to FIG. 10*b*, retainer pin section 11 is shown inserted in passageway 34 such that one flat side of bearing block 20 is contacting flat surface 32 of tooth opening 30. In the illustrated embodiment, bearing block 20 can have four sides or facets 21*a*, 21*b*, 21*c* and 21*d* although it is obvious to those skilled in the art that bearing block 20 can have any number of facets including just one facet. In other embodiments, bearing block 20 can comprise means for indexing retainer pin 10 with respect to flat surface 32 as explained as follows. In other embodiments with bearing block 20 having multiple facets, each of the facets can be configured such that they are of varying distances from the longitudinal axis of retainer pin section 11. This enables the indexing capability of retainer pin section 11. Due to casting irregularities in the manufacture of teeth and/or adaptors or wear on the tip or nose of adaptors installed on excavation tools, the distance between the longitudinal axis of passageway 34 and flat surface 32 can vary from tooth to tooth when tooth 26 is seated on adaptor 24. By providing a bearing block with facets of varying distances from a longitudinal axis of retainer pin section 11, retainer pin section 11 can be rotated or indexed from facet to facet to pick the appropriate facet that snugly contacts flat surface 32 on tooth 26 to keep tooth 26 seated on adaptor 24.

Figure 11:
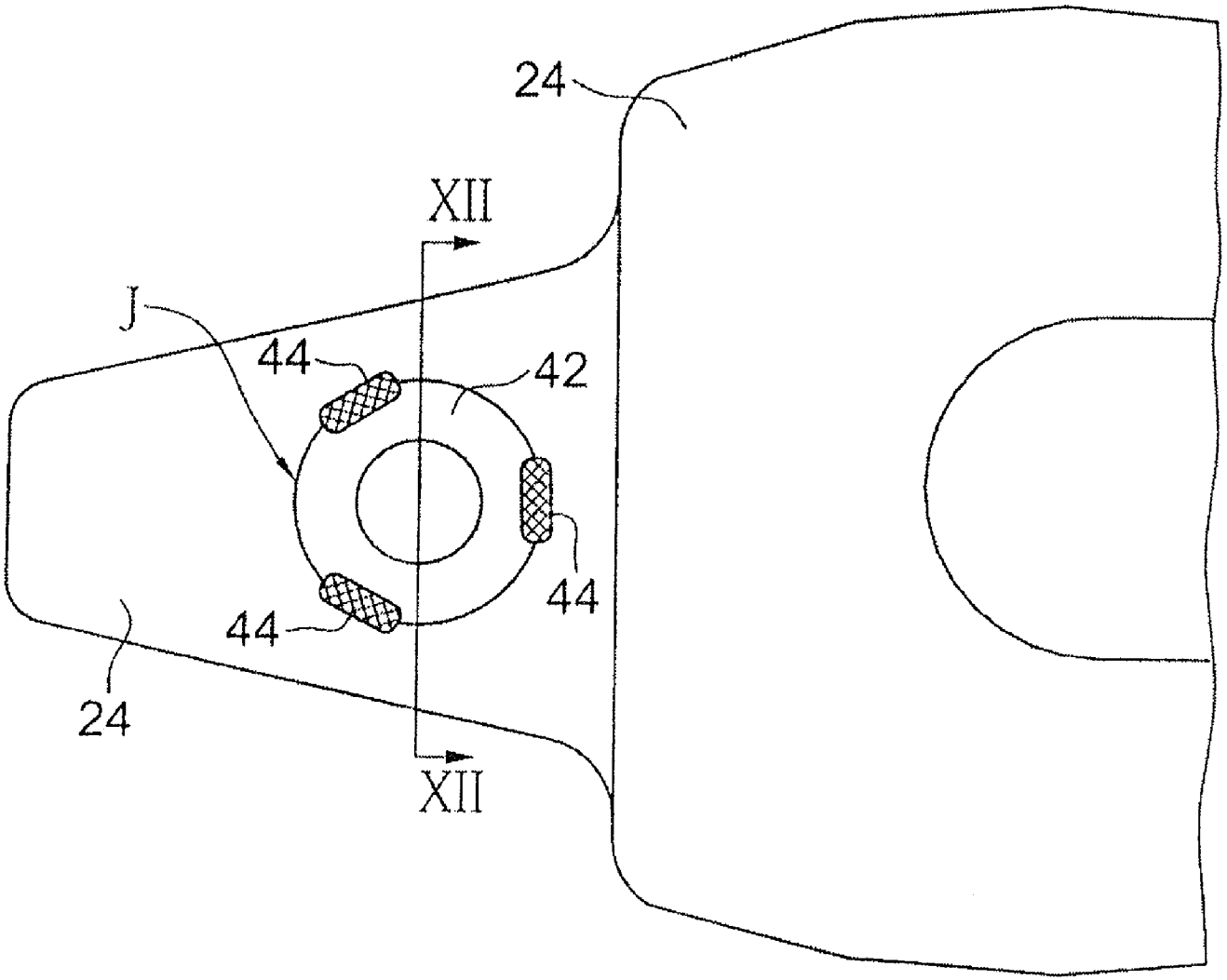
FIG. 11 is a side elevation view depicting a prior art adaptor fitted with a circular insert spacer welded into the retainer spring clamp cavity.
Figure 12:
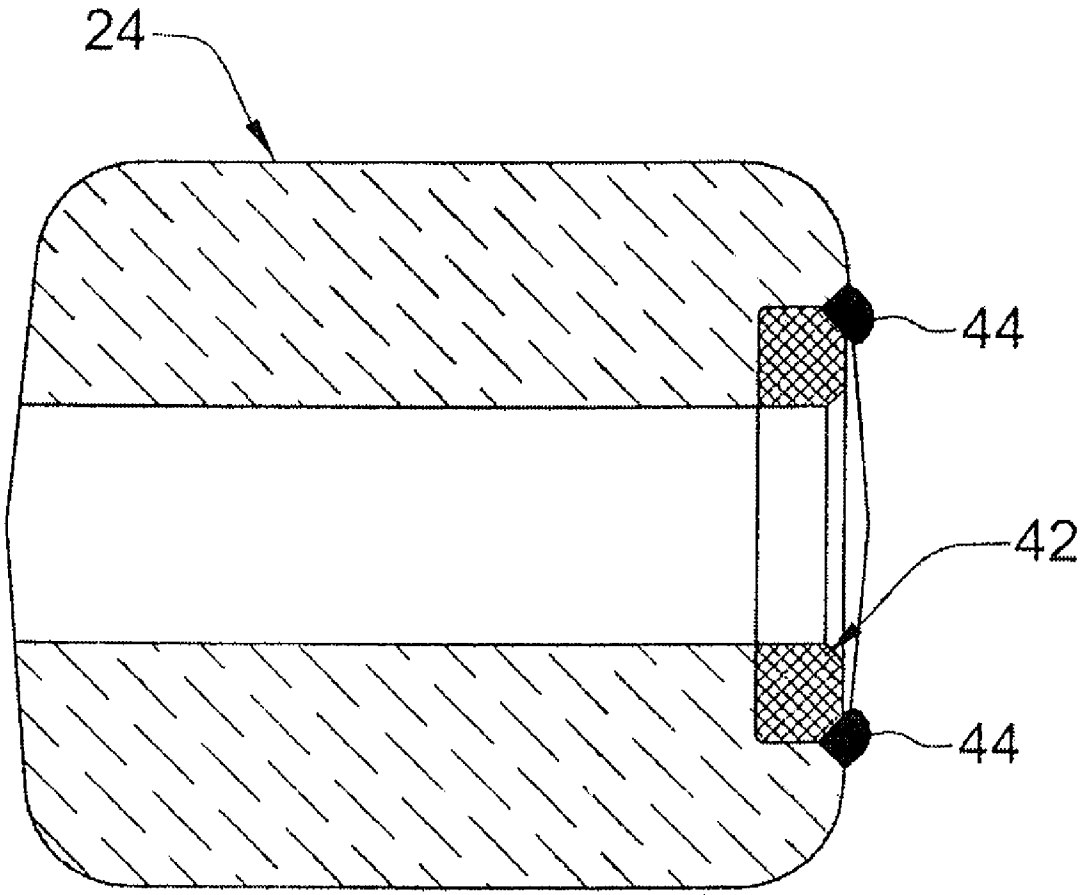
FIG. 12 is a cross section view depicting the adaptor of FIG. 11 along section line XII-XII.

Referring to FIGS. 11 and 12, adaptor 24 is shown having a circular insert spacer 42 positioned in recessed hole J. Spacer 42 can be secured to adaptor 24 with welds 44. By providing insert spacer 42, existing prior art adaptors 24 can be modified to use the retainer pin and tooth described in this specification. Circular insert spacer 42 simply provides means to build out passageway 34 on adaptor 24 so as to enable the use of retainer pin sections 11 on both sides of adaptor 24.

In other embodiments, a kit can be provided to replace worn teeth on excavation tools. In one embodiment, the kit can comprise at least one retainer pin section 11. In another embodiment, the kit can comprise at least one tooth 26. In a further embodiment, the kit can comprise at least one tooth 26 and at least one retainer pin 11. In yet another embodiment, the kit can comprise at least one tooth 26, at least one adaptor 24 and at least one retainer pin section 11.

In further embodiments, the kit can comprise at least one retainer pin section 11 and at least one insert spacer 42. In other embodiments, the kit can comprise at least one tooth 26, at least one retainer pin section 11 and at least one insert spacer 42.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

We claim:

1. A retainer pin for securing an excavation tooth to a tooth adaptor, the tooth configured to seat onto the adaptor, the adaptor having a passageway configured to receive the retainer pin, the tooth having at least one passageway that substantially aligns with the adaptor passageway when the tooth is seated on the adaptor, the at least one tooth passageway having a planar flat surface disposed on a sidewall thereof, the retainer pin comprising:

a) at least one pin section having a body with a longitudinal axis, the pin section having an inner end and an outer end;

b) a bearing block disposed on the outer end of the at least one pin section, the bearing block larger in diameter than the at least one pin section body; and c) the bearing block further comprising means for indexing the at least one pin section with respect to the planar flat surface, the indexing means comprising a first flat surface configured for a sliding fit with the planar flat surface of the at least one tooth passageway when the at least one pin section is inserted, inner end first, through the at least one tooth passageway into the adaptor passageway thereby securing the tooth to the adaptor.

2. The retainer pin as set forth in claim 1 further comprising a magnet disposed on the inner end of the at least one pin section.

3. The retainer pin as set forth in claim 2 further comprising a second pin section having a magnet configured to attract the magnet of the at least one pin section when the inner ends of the pin sections are in proximity to one another whereupon inserting the pin sections through the tooth's passageways into the adaptor passageway, the magnets of the pin sections urge the pin sections towards one another to substantially keep the pin sections in the adaptor passageway.

4. The retainer pin as set forth in claim 1 wherein the indexing means further comprises a second flat surface configured to align with the planar flat surface of the at least one tooth passageway when the at least one pin section is inserted, inner end first, through the at least one tooth passageway into the adaptor passageway thereby securing the tooth to the adaptor.

5. The retainer pin as set forth in claim 4 wherein the displacement between the second flat surface and the longitudinal axis is not equal to the displacement between the first flat surface and the longitudinal axis.

6. The retainer pin as set forth in claim 1 wherein the bearing block further comprises a lug for allowing the retainer pin section to be removed from the adaptor passageway.

7. An excavation tooth for use with an adaptor having a retainer pin passageway, the tooth comprising at least one opening disposed in a sidewall of the tooth, the at least one opening having a planar flat surface disposed on a sidewall of the opening, the planar flat surface configured for a sliding fit with a first flat surface disposed on a bearing block of a retainer pin section when the retainer pin section is inserted through the at least one opening into the retainer pin passageway thereby securing the tooth to the adaptor.

8. A kit for an excavation tooth and adaptor assembly, the assembly comprising an adaptor and a tooth configured to seat onto the adaptor, the adaptor having a passageway configured to receive a retainer pin, the tooth having at least one passageway that substantially aligns with the adaptor passageway when the tooth is seated on the adaptor, the at least one tooth passageway comprising a planar flat surface disposed on a sidewall thereof, the kit comprising:

a) at least one pin section having a body with a longitudinal axis, the pin section having an inner end and an outer end;

b) a bearing block disposed on the outer end of the at least one pin section, the bearing block larger in diameter than the at least one pin section body; and c) the bearing block further comprising means for indexing the at least one pin section with respect to the planar flat surface, the indexing means comprising a first flat surface configured for a sliding fit with the planar flat surface of the at least one tooth passageway when the at least one pin section is inserted, inner end first, through the at least one tooth passageway into the adaptor passageway thereby securing the tooth to the adaptor.

9. The kit as set forth in claim 8 further comprising at least one tooth.

10. The kit as set forth in claim 9 further comprising at least one adaptor.

11. The kit as set forth in claim 8 wherein the bearing block further comprises a lug for allowing the at least one pin section to be removed from the adaptor passageway.

12. A kit for an excavation tooth and adaptor assembly comprising at least one excavation tooth for use with an adaptor having a retainer pin passageway, the at least one tooth comprising at least one opening disposed in a sidewall of the tooth, the at least one opening having a planar flat surface disposed on a sidewall of the opening, the planar flat surface configured for a sliding fit with a first flat surface disposed on a bearing block of a retainer pin section when the retainer pin section is inserted through the at least one opening into the retainer pin passageway thereby securing the tooth to the adaptor.

13. A kit for an excavation tooth and adaptor assembly, the assembly comprising an adaptor and a tooth configured to seat onto the adaptor, the adaptor having a retainer pin passageway configured to receive a retainer rain and a recess substantially aligned with the adaptor passageway for receiving a spring clip, the tooth having at least one passageway that substantially aligns with the adaptor passageway when the tooth is seated on the adaptor, the at least one tooth passageway having a planar flat surface, the kit comprising:

a) at least one retainer pin assembly comprising:

i) at least one retainer pin section having a body with a longitudinal axis, the pin section having an inner end and an outer end, ii) a bearing block disposed on the outer end of the at least one retainer pin section, the bearing block larger in diameter than the at least one retainer pin section body, and iii) the bearing block further comprising means for indexing the at least one retainer pin section with respect to the flat surface, the indexing means comprising a first flat surface configured for a sliding fit with the flat surface of the at least one tooth passageway when the at least one retainer pin section is inserted, inner end first, through the at least one tooth passageway into the adaptor passageway thereby securing the tooth to the adaptor; and b) an insert spacer configured to be inserted into the recess of the adaptor.

14. The kit as set forth in claim 13 wherein the at least one retainer pin section further comprises a magnet disposed on the inner end thereof.

15. The kit as set forth in claim 13 wherein the retainer pin assembly further comprises a second retainer pin section for inserting into the adaptor passageway.

16. The kit as set forth in claim 13 further comprising at least one tooth.

17. The kit as set forth in claim 13 wherein the bearing block further comprises a lug for allowing the retainer pin section to be removed from the adaptor passageway.

* * * * *